US005465023A

United States Patent [19]

Garner

[11] Patent Number: 5,465,023

[45] Date of Patent: Nov. 7, 1995

[54] CARBON-CARBON GRID FOR ION ENGINES

[75] Inventor: Charles E. Garner, La Canada, Calif.

[73] Assignee: The United States of America as represented by the Administrator of the National Aeronautics and Space Administration, Washington, D.C.

[21] Appl. No.: 89,064

[22] Filed: Jul. 1, 1993

[51] Int. Cl.[6] ..... H01J 1/46

[52] U.S. Cl. ..... 313/293; 313/299

[58] Field of Search ..... 313/293, 294, 313/299, 311, 334, 348, 350, 633

[56] References Cited

U.S. PATENT DOCUMENTS 3,852,633 12/1974 Hunter ..... 313/348

4,553,063 11/1985 Geibig et al. ..... 313/311

OTHER PUBLICATIONS

Demonstration and Evaluation of Carbon Ion Optics by Hedges & Meserole; Boeing Defense & Space Group; pp. 1–9.

AIAA 92–3149 Fabrication Testing of Carbon–Carbon Grids for Ion Optics; Garner & Brophy, Jul. 6–8, 1992, pp. 1–11.

*Primary Examiner*—Edward L. Coles, Sr.
*Assistant Examiner*—Jerome Grant, II
*Attorney, Agent, or Firm*—John H. Kusmiss

[57] ABSTRACT

A method and apparatus of manufacturing a grid member for use in an ion discharge apparatus provides a woven carbon fiber in a matrix of carbon. The carbon fibers are orientated to provide a negative coefficient of thermal expansion for at least a portion of the grid member's operative range of use.

20 Claims, 4 Drawing Sheets

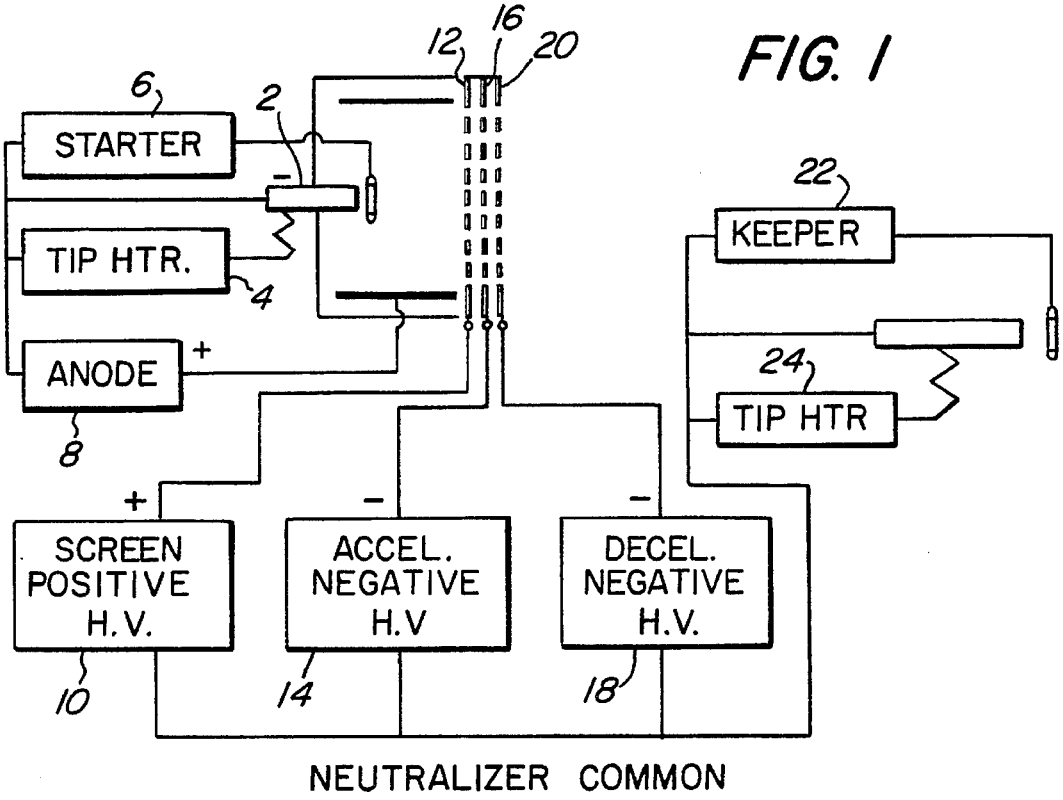
FIG. 2
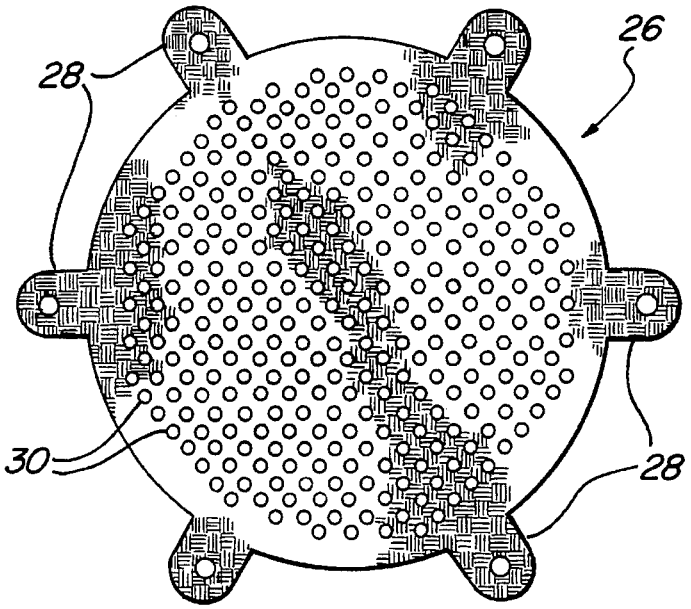

CARBON-CARBON GRID FOR ION ENGINES

ORIGIN OF THE INVENTION

The invention described herein was made in the performance of work under a NASA contract, and is subject to the provisions of Public Law 96-517 (35 U.S.C. §202) in which the Contractor has elected not to retain title.

TECHNICAL FIELD

The present invention is directed to an improved ion discharge apparatus and, more particularly, to an improved grid member which resists grid erosion and thermal distortion.

BACKGROUND ART

An ion discharge apparatus basically creates plasma from neutral atoms and accelerates the ions in a desired direction. A stream of discharged ions can be used to irradiate a target, or even to provide ion propulsion to spacecraft. Thus, high-power ion propulsion utilizing ion engines or thrusters have been created with a design life to extend for a significant period of time.

The performance of an ion thruster depends chiefly on the design and performance of the ion extraction grids. Fundamentally, the maximum beam current that the grids can extract for a fixed specific impulse is limited by space-charge effects, electron backstreaming, and electrical breakdown (arcing) between the grids. These effects themselves are related to the hole alignment between the screen, accelerator, and decelerator grids, and to the grid-to-grid separation distances.

The problems inherent in increasing the thrust density of ion engines are grid erosion and thermal distortion which changes the grid separation distances. Grid erosion, due to ion sputtering of the grid surfaces by discharge chamber or charge-exchange ions, becomes more severe as the thrust density increases because there are more ions to erode the grids. Thermal distortion is due to nonuniform heating, and the resulting thermal expansion, of the grid electrodes because of radial and grid-to-grid temperature gradients.

For several reasons, inert gases have replaced mercury as the propellants of choice for proposed interplanetary and earth-orbital ion propulsion systems. Erosion rates on ion engine discharge components, however, are expected to be greater with inert gas propellants than the corresponding rates with mercury. This is due in part to the higher sputter yields of the inert gases as compared to mercury. In addition, discharge and beam currents in ion engines operated on inert gases will be greater compared to ion engines that operate on mercury propellant, for the same thrust level. These combined effects will limit the operating life of inert-gas ion engines.

Presently, state-of-the-art grids are fabricated from molybdenum sheets. To mitigate the grid distortion problems, the grids are dished by hydroforming; for example, a J-series engine grid is dished approximately 2.0 cm over the 30-cm diameter. With this technology molybdenum grids have been fabricated up to 50 cm in diameter.

However, there are limits to dished molybdenum grid technology. For example, it is difficult to hydroform the grids uniformly across the entire diameter of the grid, which leads to a nonuniform grid gap. In addition, the hydroforming process may cause grid-to-grid hole misalignment. The finite coefficient of thermal expansion for molybdenum results in thermal distortion which becomes more severe as the grid diameter is increased.

Thus, in applications of grid members that may be subject to significant heat and erosion, the prior art is still seeking to optimize the performance of ion discharge apparatus.

STATEMENT OF THE INVENTION

The present invention provides an improved grid member that can be used in an ion discharge apparatus. The grid member can be formed of carbon fibers orientated to provide a negative coefficient of thermal expansion for at least a portion of the grid member's operative range of use. For example, the grid member can have a negative coefficient of thermal expansion from at least 0° to 600° K. The body member can be formed from a laminated series of woven fiber sheets or plies. The plies can include fiber bundles woven into a square weave, with the adjacent fiber plies being orientated at a relative angle of 45 degrees to each other from their weave pattern. The woven carbon fibers are impregnated in a matrix of carbon. The type of the carbon fibers used and application of a graphitization process permits the grid member to have a specific negative coefficient of the thermal expansion.

In the production of a grid member, carbon fibers, which have been bundled into a thread, can be woven into a square weave approximately 13 mm thick. These plies or sheets of fibers can then be joined into a particular alignment with a phenolic resin. The structure can then be fixed within graphite plates. A heat curing procedure can cause cross-linking of the resin polymers.

A carbonization procedure is used under controlled carbonization cycles in an inert atmosphere to drive off any volatiles from the resin, leaving only carbon. The laminate structure can then be heat stabilized to achieve the desired tensile and flexural modulus and coefficient of thermal expansion characteristics. This graphitization process can be performed at 1800° C. for from 12 to 24 hours. This further permits crystal alignment of the graphite crystals to provide the desired coefficient of thermal expansion characteristics. A chemical vapor infiltration technique is utilized wherein a diffusion of a hydrocarbon gas is inserted into the surface of the substrate of the blank at high temperatures for 24 to 48 hours. In this procedure, the hydrocarbon gas can break down to deposit carbon with the hydrogen being evacuated. As a result, a carbon matrix is formed so that a carbon fiber-reinforced carbon composite is provided.

The graphitization process and chemical vapor infiltration process can be repeated until the desired final grid blank configuration is achieved. Subsequently, the grid blank can be subject to either mechanical drilling, laser machining, or an electric discharge machining technique to provide the desired size and placement of holes to complete the grid structure.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 1 is a schematic of an ion propulsion engine;

FIG. 2 is a plan view of a carbon-carbon grid;

DETAILED DESCRIPTION OF THE INVENTION

Figure 3:
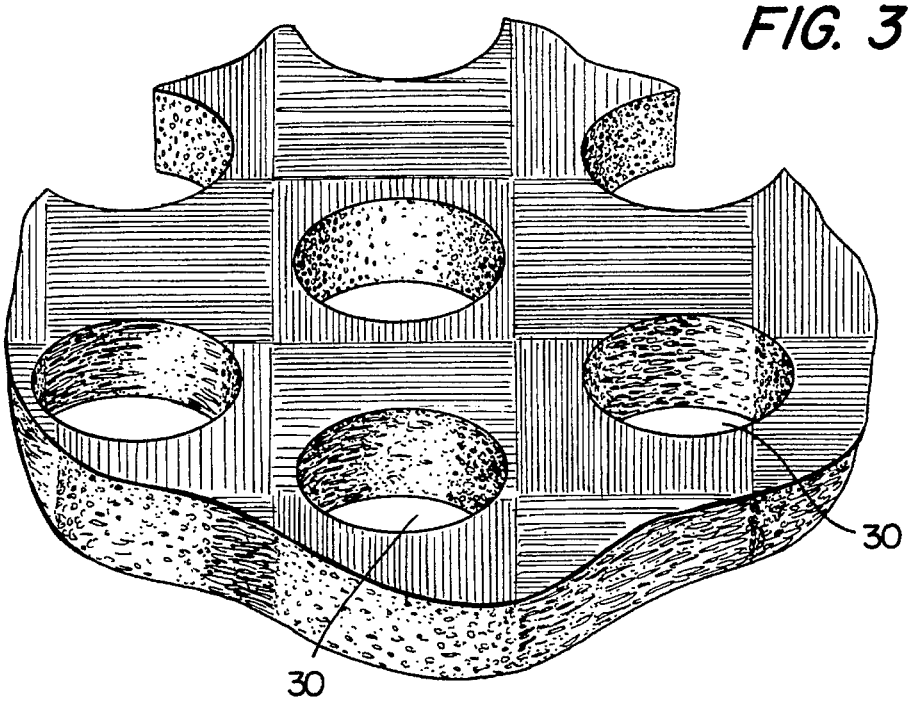
FIG. 3 is a partial schematic view of a portion of the grid of FIG. 2.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a carbon composite grid panel for an ion discharge apparatus.

FIG. 1 discloses a schematic of an electric propulsion system, such as an ion engine, that can be utilized for an extended useful life period in outer space. A hollow cathode 2 heated by a tip heater receives a propellant gas and creates the electrons which create the plasma of ions. A starter 6 is connected to a keeper electrode to start and maintain the initial plasma from the cathode 2. The anode 8 then assists in creating the anode plasma. A positive screen, high-voltage source 10 is connected to a screen grid 12. A source of an accelerator negative high voltage 14 is connected to an accelerator grid 16, while a source of a decelerator negative high voltage 18 is connected to a decelerator grid 20. A neutralizer arrangement showing a keeper 22 and a tip heater 24 are also disclosed to provide a neutralization of the ejected ions.

Unlike the conventional grid screens of molybdenum, the respective screens 12, 16, and 20 are flat, thereby facilitating hole alignment. For further background information on this structure, reference is made to the JPL publication No. 92-10, "Electric Propulsion System Technology Annual Report—1991," November 1992 (incorporated herein by reference).

Pursuing a solution to the problem of previous grid screens formed of molybdenum resulted in a consideration of utilizing a new form of material.

Graphite is an attractive material for use in high-temperature applications in space-like environments. The strong affinity that carbon atoms have for each other, coupled with the unique crystalline properties of graphite, result in a material with high compressive strength which actually increases with temperature (up to 2500° C.), a low elastic modulus, high thermal and electrical conductivity, a high sublimation temperature (3649° C.), and exceptional inertness to chemical reactions except for high-temperature reactions with hydrogen and elements in columns 6 and 7 of the periodic table (oxygen, chlorine, fluorine, etc.). However, in the bulk form, monolithic graphite has limited applications for structures such as ion optics because of low strain to failure ratio (brittleness).

Accordingly, the present invention is directed to carbon-carbon composites, or carbon fiber reinforced carbon composites (CFC), which are defined herein as structures consisting of fibrous carbon substrates in a carbonaceous matrix. Carbon-carbon composites combine the desirable materials properties of carbon and graphite with the strength provided by weaving carbon fibers into an integral structure. Additional strength and mechanical stability is added when a matrix of carbon is incorporated into the structure by liquid impregnation or chemical vapor infiltration processes.

Tests indicate that carbon-carbon is believed to be superior to molybdenum for use as a grid material. The materials properties of carbon-carbon can be modified to provide a near-zero coefficient of thermal expansion over a temperature range of approximately 0°–800° K., which would be the principal operative range of an ion engine (see FIG. 4). Thus, the CFC grids should not distort thermally as much as dished molybdenum grids, and can therefore be made from flat sheets. Hole alignment between the screen, accelerator, and decelerator grids is also believed to be superior due to the elimination of the need to compensate the hole alignment for dished grids.

Figure 5:
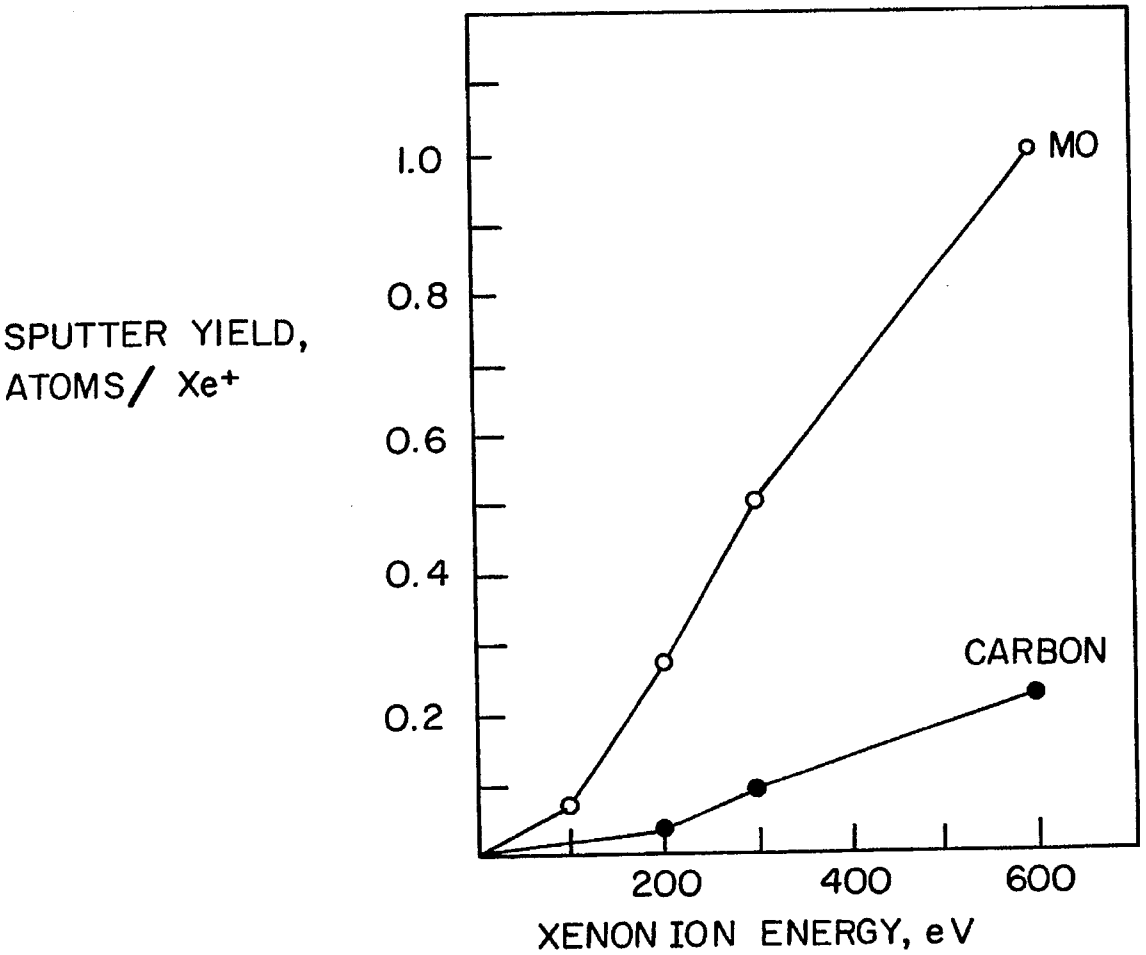
FIG. 5 is a comparison graph of the sputter yield of molybdenum and carbon.

With the reduced thermal distortion, it should be possible to fabricate accelerator and decelerator grids that are thicker, but with the same hole diameters, as are used in molybdenum grids. In addition, the sputter yield of carbon is approximately a factor of 5 lower than the sputter yield for molybdenum over the ion energy range of interest (see FIG. 5). These materials properties of carbon-carbon can permit the fabrication of ion engine grids which can process more power per unit area and have longer operating lifetimes than current state-of-the-art grids fabricated from molybdenum.

Thin panels of carbon-carbon of dimensions 21.6×21.6 ×0.1 cm were fabricated from Amoco P-95 carbon fibers, which are commercially available. These fibers were extruded through dies in groups of 2000 from special blends of petroleum pitch, a residue of petroleum. Amoco P-95 carbon fibers are still a developmental product; therefore, at this writing no informational data sheet on the properties and characteristics of P-95 fiber is available. However, it is expected that the materials properties of Amoco P-95 are similar to the materials properties of Amoco P-100 fibers.

The materials properties of P-100 fibers are shown in Table 1. P-95 fibers were selected for ion grid plate fabrication because of their expected desirable materials properties and reduced cost. This fiber is not the strongest and stiffest fiber that can be used, but the fibers are sufficiently ductile that they can be woven into virtually any shape required. The data show that the P-100 fibers have an extremely high thermal conductivity in the fiber direction and a tensile strength almost twice the value for molybdenum.

TABLE 1

Physical Properties of Stress-Relieved Molybdenum and Amoco P-100 Carbon Fibers

| Property | Units | Mo | P-100 |
|---|---|---|---|
| Tensile Strength | GPa | 1.2 | 2.37 |
| Density | g/cm$^3$ | 10.2 | 2.15 |
| Longitudinal Thermal Conductivity | W/m-°K. | 138 | 520 |
| Electrical Resistivity | μΩ-m | 0.5 | 2.5 |
| Longitudinal CTE | PPM/°K. | 5.43 | −1.5 |
| Melting Point | °K. | 2890 | 4000 |
| Filament Diameter | μm | | 10 |

To fabricate the panels, individual carbon fibers 10 micrometers in diameter were bundled into groups of 2000 (called the "tow") and woven into plies approximately 0.34 mm thick using a square weave reinforcing geometry (see FIGS. 2 and 3) and 12 fiber "tows" per 25.4 mm in both the x and y directions of the plane. The fiber bundles in a square weave are weaved under and over adjoining fiber bundles. Three plies were joined with phenolic resin prepeg to form plates approximately 21.6 cm ×21.6 cm and 1.0 mm thick. The fiber bundles in the middle ply were oriented at an angle of ±45 degrees with respect to the top and bottom plies to provide for a more uniform shear rigidity. Industry has limited experience in fabricating panels with a width-to-thickness ratio typical for 30-cm ion engine grids; to increase the probability that the panels would be flat, the plies were fabricated oversized such that the panels could later be lapped to the desired final thickness of 0.76 mm.

The carbon matrix which fills the pores and spaces between the fibers (a process called densification) was deposited using a chemical vapor infiltration (CVI) technique that involves diffusion of a hydrocarbon gas into the surface of the substrates. The panels are heated to high temperatures to drive off volatiles, leaving only carbon to fill the voids and form the matrix of the CFC structure. CVI processes are very efficient to densify structures up to 6.5 mm or less in thickness. The most important function of the matrix is to evenly distribute the load from one fiber to the next. A matrix of carbon impregnated into a carbon-carbon panel is shown in FIGS. 2 and 3. The grid member 26 includes mounting lobes 28 and a plurality of holes 30. The grid member 26 is flat.

The procedures used to fabricate the grid panels are summarized as follows: 1. Weave fabric into plate-like plies, join plies with phenolic resin preform, heat-stabilize fabric to achieve desired modulus and CTE characteristics. 2. Heat cure to cause cross-linking of resin polymers. 3. Carbonize under controlled carbonization cycles and in an inert atmosphere to drive off volatiles, leaving carbon. 4. Densify the structure using chemical vapor intrusion processes to fill voids and graphitization to strengthen the matrix. 5. Machine the hole pattern with an electrodischarge machining process. 6. Heat-treat panels at high temperature (graphitize) to increase preferred orientation of graphite crystals in the fiber which results in stiffer panels with desirable CTE characteristics.

The density of the fabricated carbon-carbon panels is approximately 1.69 g/cm$^3$; the fiber accounts for approximately 55% of the mass of the structure, with the balance from the matrix carbon.

Tensile, compressive, and flexural moduli for both carbon-carbon panels and molybdenum are shown in Table 2. Data were obtained from 3-point bend tests conducted on strips of carbon-carbon cut from the panels. It has been noted previously that the pitch-based fibers used to fabricate panels have an extremely high tensile strength and tensile modulus. Data from Table 2 indicate that the tensile modulus of the panels is in the range of $10^8$ Pa; the value is lower than would be expected from the materials properties of the fiber, due to orientating the middle ply at an angle of 45 degrees with respect to the top and bottom plies, which may provide for a more uniform shear rigidity.

TABLE 2

Physical Properties of Fabricated Plates

| Property | Units | Panel, No Holes | Panel, 63% Open Area |
|---|---|---|---|
| Tensile Modulus | Pa | $9.7 \times 10^7$ | NP[a] |
| Ultimate Stress | Pa | $1.2 \times 10^8$ | NP[a] |
| Max Fiber Stress | Pa | $1.8 \times 10^8$ | $2.8 \times 10^7$ |

TABLE 2-continued

Physical Properties of Fabricated Plates

| Property | Units | Panel, No Holes | Panel, 63% Open Area |
|---|---|---|---|
| Flexural Modulus | Pa | $1.6 \times 10^8$ | $5.8 \times 10^7$ |

[a]NP = not performed

Of importance is the flexural modulus, a property which is indicative of the ability of the panels to resist deformation normal to the plane of the panels due to forces such as electric field stresses between the screen and accelerator grids. One of the undesirable properties of carbon-carbon is a low flexural modulus. The data in Table 2 show that the flexural modulus of the panels are approximately half the value for molybdenum, which is $3.2\times10^8$ Pa. The value for flexural modulus with the grids operating in an ion engine should increase due to the increased stress from the negative CTE characteristic of the panel.

Tests were conducted to measure the ability of carbon panels to withstand flexure from electric field stress. Weights occupying 50% of the surface area of the grid were placed on a panel which was constrained at the periphery of a 15-cm-diameter grid mount ring. At a pressure of 8.9 N/m$^2$, there was observed a deviation at the center of 0.19 mm. Calculations show that at a grid gap of 0.25 mm, the total electrostatic pressure on the grid is 134 N/m$^2$. Therefore, a deviation in flatness at the grid center of 0.05 mm can be expected if deviation scales directly with the electrostatic pressure.

In Table 2 values for flexural modulus are shown for panels both with and without holes. Samples with holes were machined to an open area of 63% with hole diameters of 3.6 mm. With approximately 63% open area the flexural modulus decreased by 64%; these data indicate that the flexural modulus for carbon-carbon scales with the open area, even though a large number of fibers have been cut in the hole-machining process.

Figure 4:
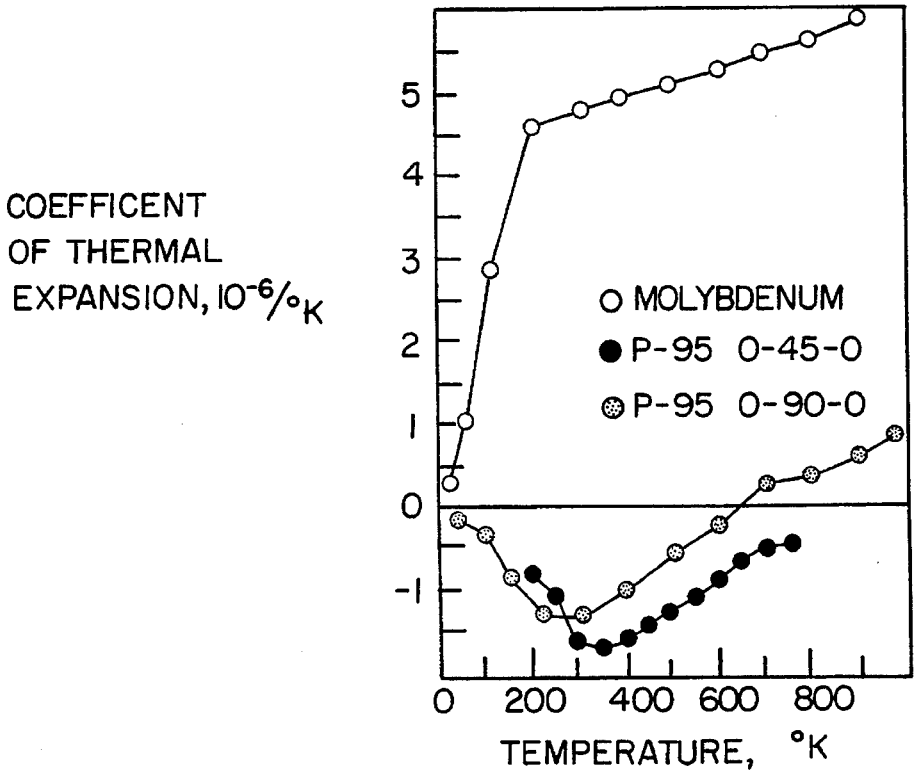
FIG. 4 is a thermal expansion comparison graph of molybdenum and carbon-carbon grids.

Referring to FIG. 4, the coefficients of thermal expansion (CTE) properties of the carbon-carbon p-95 panels were measured using a quartz dilitometer. Test samples of carbon-carbon panels 7.1 cm in length were first dried in an oven at 80° C. for two hours. CTE as a function of temperature for the CFC panels and molybdenum are shown. Data for two different panels with 45-degree or 90-degree fiber orientation are shown. The data for the 45-degree orientation panels represent the average of two different panels. The accuracy of the measurement has been determined to be $0.2\times10^{-6}$/° K.

The CTE for the panels is negative in the complete temperature range tested, which was 200°–800° K. The CTE curve for P-95 carbon-carbon has a maximum negative value at approximately 350° K. The curve does not cross zero within the temperature range tested, but a CTE value of zero can be inferred from the data in FIG. 4 to be at approximately 900° K. Beyond this temperature the CTE can be expected to increase to a positive value, but remain low relative to CTE values that would be obtained with molybdenum at the same temperature. As can be appreciated, the negative CTE will place the mounted grid in tension and will prevent the thermal- distortion experienced by molybdenum.

The fibers used to fabricate these panels contain a high degree of preferred crystalline orientation whose graphitic planes are closely aligned with the axis of the fiber. When the fiber is heated, vibrations transverse to the fiber axis are excited, which results in an increase in the distance between graphitic planes in a direction normal to the fiber axis and a reduction in the atom-to-atom distances in a direction parallel to the fiber axis; in addition, crystalline voids in the fiber are partially filled. These two characteristics result in a material that has a negative coefficient of thermal expansion (CTE) in the direction of the fiber; the CTE remains negative until a temperature is reached where longitudinal vibrations in the graphitic planes are excited, and the physical properties of the matrix contribute to the CTE characteristics of the panel. Crystalline orientation in the matrix is far less uniform than in the fibers; the densification process does not allow for appreciable preferred orientation of the graphitic planes in the carbon matrix. Therefore, as the panel heats up, the CTE eventually becomes positive, due to the lower degree of preferred orientation in the matrix and to the excitation of longitudinal vibrations in the graphitic planes.

Typical screen and accelerator grid temperatures range from 200°–675° K. The CTE data for the CFC panels imply that because the CTE remains negative or approaches zero at temperatures typical for ion extraction grids for ion engines, grid panels can be fabricated from flat plates of carbon-carbon and will not distort due to thermal expansion.

Sputter yield data indicate that carbon has one of the lowest erosion rates of all of the elements. Low erosion rates may be a significant benefit for ion engine grids fabricated from carbon-carbon. However, it is not known if the sputter yield of carbon-carbon is similar to that of elemental carbon.

Tests to measure the relative erosion rates of carbon-carbon and molybdenum eroded by 40–80 eV argon ions were conducted in a stainless-steel vacuum chamber 2.3 m in diameter and 4.6 m in length, and pumped by silicon-based oil diffusion pumps. Vacuum tank pressure was measured using a calibrated ionization gauge tube and controller. No-load tank pressure was $2.4\times10^{-5}$ Pa. The erosion badges were identical to those used in the discharge chamber erosion tests. The beam current density at the badge surfaces was measured with a simple button probe. With knowledge of the ion beam current density and the erosion rate, the sputter yield of the badges can be calculated and compared to values published in the literature.

Results for these erosion tests are shown in Table 3, along with the calculated sputter yield based upon the measured beam current density and erosion rate.

TABLE 3

Erosion Rates of Molybdenum and P-95 Carbon—Carbon Bombarded by 500 eV Argon Ions and 1.0 mA/cm$^2$ Beam Current Density

| | Mo | P-95 CFC |
|---|---|---|
| Expected Erosion Rate mm/Hr | $2.4 \times 10^{-3}$ | $1.9 \times 10^{-4}$ |
| Erosion Rate Uncertainty mm/Hr | $1.1 \times 10^{-3}$ | $1.1 \times 10^{-4}$ |
| Expected Sputter Yield | 0.74 | 0.10 |
| Sputter Yield, Ref. 40 | 0.82 | 0.12 |

Mechanical drilling, laser machining, and electric discharge machining techniques can be used. Mechanical drilling of holes was generally difficult because of damage to the webbing in the exit side of the hole caused by mechanical pressure, and by fibers which are caught by the drill bit and pulled away from the structure. Mechanical drilling for holes under 2.5 mm was successful only when the open area required was approximately 50% or less. However, efforts to mechanically machine the carbon-carbon grids to an open area of up to 63% were successful when the hole diameter exceeded approximately 4.0 mm. Mechanical drilling may be suitable for advanced carbon-carbon grids of larger thickness and hole diameters because of reduced cost.

A conventional electric discharge machining (EDM) was used to create a screen grid with holes 1.91 mm in diameter in a hexagonal array to an open area of 0.67. The accelerator and decelerator grids were machined with holes 1.59 mm in diameter in a hexagonal array to an open area of 0.47. The hole diameter and hole placement in the array were held to ±0.025 mm. The use of EDM is the preferred form of providing holes, although laser machining is also possible.

In summary, flat plates for ion optics were fabricated from carbon-carbon composites using a pitch-based fiber with a high tensile modulus in the plane of the optics. The plates were flat to within ±0.005 mm over an area of diameter 15 cm. Tests indicate that the panels have a negative CTE until approximately 900° K.; above this temperature the CTE is expected to have a positive value that increases slowly with increasing temperature. Erosion rate tests conducted at 40–80 eV in the discharge chamber of an ion engine operated on argon propellant at a discharge voltage of 42 volts indicate that wearout of carbon-carbon grids due to sputter erosion would be reduced relative to molybdenum electrodes. The erosion rate of carbon-carbon was unchanged when nitrogen was added to the argon propellant. The published sputter yield data indicate that accelerator grid erosion should be reduced by a factor of 5 or more relative to the erosion rate of a molybdenum operated under the same conditions (see FIG. 5). Ion extraction holes of uniform diameter and with straight sidewalls (no taper) in a high open area fraction array were machined into the carbon-carbon panels using conventional EDM. Grids fabricated from carbon-carbon may be especially appropriate for SEI applications where the grids can be thicker than the thin molybdenum J-series-type grids due to the requirement to operate at very high specific impulses.

Figure 6:
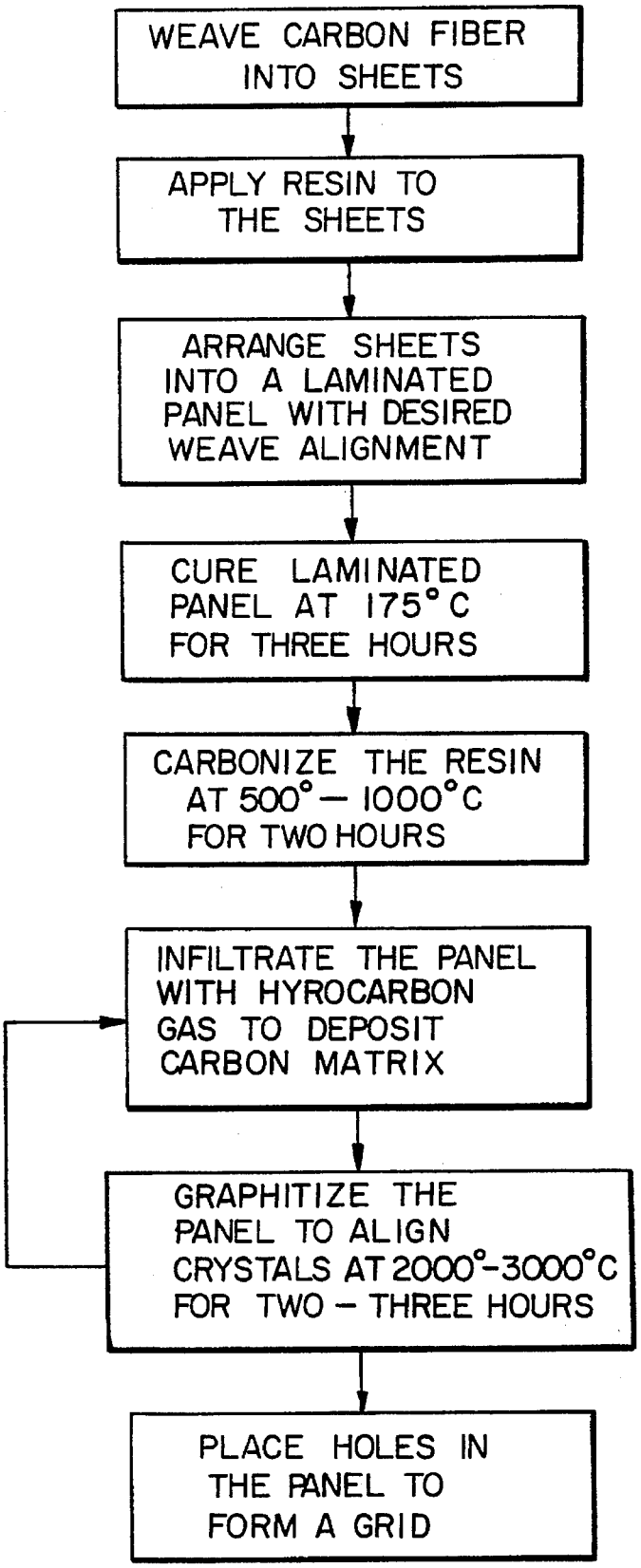
FIG. 6 is a schematic flow chart of a procedure for manufacturing carbon-carbon grids.

Referring to FIG. 6, a schematic of the process for manufacturing the grids of the present invention is provided. First, the carbon fiber is woven into sheets and resin is applied to the sheets. The sheets are then arranged into a laminated panel with the desired weave alignment. The panel is then cured at temperatures up to 175° C. for three hours. The cured laminated panel is then subject to a carbonizing step wherein the resin will have the volatile components driven off at a temperature of 500° to 1000° C. for two hours.

The laminated panel is then subjected to a chemical vapor infiltration process wherein hydrocarbon gas is bled into the panel at an elevated temperature for an extended time period. The hydrocarbon gas at that temperature will break down and deposit carbon onto the fibers, while the hydrogen will be released and evacuated from the chamber. A commercial service for performing the chemical vapor infiltration can be secured from B. F. Goodrich/Supertemp of Norwalk, Calif. The carbon fibers are now surrounded in a matrix of carbon, and a graphitization process is utilized on the panel to align the carbon crystals at 2000° to 3000° C. for two to three hours. The chemical vapor deposition step and the graphitization step can be repeated until the desired carbon composite is reached. Holes are then formed in the panel to form the screen grid, for example, by an electrode discharge machining process.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

I claim:

1. An improved grid member for use in an ion discharge apparatus comprising:

a body member formed of carbon fibers having a plurality of holes, the carbon fibers being orientated to provide a negative coefficient of thermal expansion for at least a portion of the grid member's operative range of use.

2. The invention of claim 1 wherein the body member is formed of a laminated series of fiber plies.

3. The invention of claim 2 wherein the fiber plies are fixed in a carbon matrix.

4. The invention of claim 2 wherein adjacent fiber plies are orientated at a relative angle of 45 degrees to each other.

5. The invention of claim 2 wherein the fiber plies include fiber bundles woven into a square weave.

6. The invention of claim 1 wherein the grid member has a negative coefficient of thermal expansion from at least 0° to 600° K.

7. A method of manufacturing a grid member for use in an ion discharge apparatus comprising:

weaving carbon fiber into flat ply sheets;

laminating the ply sheets into a panel;

vapor depositing carbon into the panel to fill any voids of the carbon sheets;

graphitizing the panel to enable crystal alignment; and providing holes in the panel.

8. The invention of claim 7, further including laminating the ply sheets with a phenolic resin and carbonizing the resin.

9. The invention of claim 7, further including weaving the carbon fiber into a square weave.

10. The invention of claim 7, further including heating the panel to 2000° to 3000° C. for graphitization.

11. The invention of claim 7, further including vapor infiltration of hydrocarbon gas at a temperature sufficient to separate hydrogen from carbon to deposit a carbon matrix.

12. The invention of claim 7, further including aligning adjacent ply sheets at a relative angle of 45 degrees to each other from their weave pattern.

13. The invention of claim 12, further including weaving the carbon fiber into a square weave pattern and electrodischarge machining of the holes.

14. An improved grid member for use in an ion discharge apparatus, comprising:

a body member formed of ply sheets of woven carbon fibers impregnated in a matrix of carbon, the body member having a plurality of holes aligned to enable the transmission of ions.

15. The invention of claim 14, further including a square weave pattern in each of the ply sheets and the adjacent ply sheets being orientated at a relative angle of 45 degrees to each other from their weave pattern.

16. The invention of claim 14 wherein the carbon fibers are oriented to provide a negative coefficient of thermal expansion for at least a portion of the grid member's operative range of use.

17. An improved ion discharge apparatus, comprising:

a source of ions; and means for propelling the ions, including an apertured grid screen member formed of carbon fibers in a carbon matrix, the carbon fibers being oriented to provide a negative coefficient of thermal expansion for at least a portion of the operative range of the apparatus.

18. The invention of claim 17 wherein the carbon fibers are woven into a square weave pattern.

19. The invention of claim 17 wherein the carbon fibers are woven into fiber plies and adjacent fiber plies are oriented at a relative angle of 45 degrees to each other.

20. The invention of claim 17 wherein the grid screen member has a negative coefficient of thermal expansion from at least 0° to 600° K.

* * * * *

Adverse Decisions In Interference

Patent No. 5,465,023, Charles E. Garner, CARBON-CARBON GRID FOR ION ENGINES, Interference No. 104,248, final judgment adverse to the patentee rendered December 5, 2001, as to claims 16-38.
*(Official Gazette February 12, 2002)*